US005226752A

United States Patent [19]

Guerin et al.

[11] Patent Number: 5,226,752

[45] Date of Patent: Jul. 13, 1993

[54] GOLF EQUIPMENT BRUSH

[76] Inventors: Ronald Guerin, 1385 Place Arvida, Laval, Quebec, Canada, H7E 3G9; Jean G. Laroche, 1515 N. D. Fatima, Duvernay Laval, Quebec, Canada, H7G 4V8

[21] Appl. No.: 890,807

[22] Filed: Jun. 1, 1992

[51] Int. Cl.[5] ..... A46B 11/00; A46B 11/04

[52] U.S. Cl. ..... 401/269; 15/185; 401/272; 401/273; 401/281

[58] Field of Search ..... 401/269, 272, 273, 281, 401/269, 272, 273, 281; 15/185

[56] References Cited

U.S. PATENT DOCUMENTS 2,486,847 11/1949 Hokett ..... 401/273
2,814,061 11/1957 Sieloff ..... 15/185
4,979,257 12/1990 Heneveld ..... 15/185 X

FOREIGN PATENT DOCUMENTS 1006772 4/1952 France ..... 401/281
63044 7/1955 France ..... 401/273

*Primary Examiner*—Steven A. Bratlie
*Attorney, Agent, or Firm*—Leon Gilden

[57] ABSTRACT

A golf equipment brush is provided for ease of transport and manual manipulation by individuals for the cleaning of golf clubs and associated golfing accessories to include a brush head mounted within a housing in a separable orientation relative to one another. The housing is arranged for selective torso or equipment support by directing a loop relative to the housing, and the brush including a matrix of bristle tufts mounted to a floor of the brush head. A first embodiment of the invention includes the brush head arranged for a snap-fit interconnection within the housing along a floor thereof, with a second embodiment including a spring-biased interconnection of the brush relative to the housing. A further embodiment of the invention includes the brush head pivotally mounted relative to the housing for selective release therefrom for ease of manual manipulation of the brush in use.

1 Claim, 4 Drawing Sheets

GOLF EQUIPMENT BRUSH

BACKGROUND OF THE INVENTION

1. Field of the Invention

The field of invention relates to golf equipment, and more particularly pertains to a new and improved golf equipment brush wherein the same is arranged for the disassembly relative to a support housing for the cleaning of various golf equipment by individuals.

2. Description of the Prior Art

Golf brushes of various types are utilized in the prior art to remove debris particularly from contact surfaces between golf clubs and associated golf ball to provide for desired contact between the components and the maintenance of equipment in optimum condition. Prior art golf club cleaning structure is exemplified in U.S. Pat. Nos. 4,472,851; 4,940,349; and 4,872,232 to permit the use of various fluids and brush assemblages in the cleaning of golf club heads.

The U.S. Pat. No. 4,965,906 to Mauro sets forth a combination golf ball and club head cleaner positioned within a unitary housing.

As such, it may be appreciated that there continues to be a need for a new and improved golf equipment brush as set forth by the instant invention which addresses both the problems of ease of use as well as effectiveness in construction for ease of cleaning of golf equipment and in this respect, the present invention substantially fulfills this need.

SUMMARY OF THE INVENTION

In view of the foregoing disadvantages inherent in the known types of golf equipment brush now present in the prior art, the present invention provides a golf equipment brush wherein the same is arranged for ease of portability and removal relative to a housing to permit the selective cleaning of golf equipment. As such, the general purpose of the present invention, which will be described subsequently in greater detail, is to provide a new and improved golf equipment brush which has all the advantages of the prior art golf equipment brush and none of the disadvantages.

To attain this, the present invention provides a golf equipment brush provided for ease of transport and manual manipulation by individuals for the cleaning of golf clubs and associated golfing accessories to include a brush head mounted within a housing in a separable orientation relative to one another. The housing is arranged for selective torso or equipment support by directing a loop relative to the housing, and the brush including a matrix of bristle tufts mounted to a floor of the brush head. A first embodiment of the invention includes the brush head arranged for a snap-fit interconnection within the housing along a floor thereof, with a second embodiment including a spring-biased interconnection of the brush relative to the housing. A further embodiment of the invention includes the brush head pivotally mounted relative to the housing for selective release therefrom for ease of manual manipulation of the brush in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf equipment brush which has all the advantages of the prior art golf equipment brush and none of the disadvantages.

It is another object of the present invention to provide a new and improved golf equipment brush which may be easily and efficiently manufactured and marketed.

It is a further object of the present invention to provide a new and improved golf equipment brush which is of a durable and reliable construction.

An even further object of the present invention is to provide a new and improved golf equipment brush which is susceptible of a low cost of manufacture with regard to both materials and labor, and which accordingly is then susceptible of low prices of sale to the consuming public, thereby making such golf equipment brush economically available to the buying public.

Still yet another object of the present invention is to provide a new and improved golf equipment brush which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
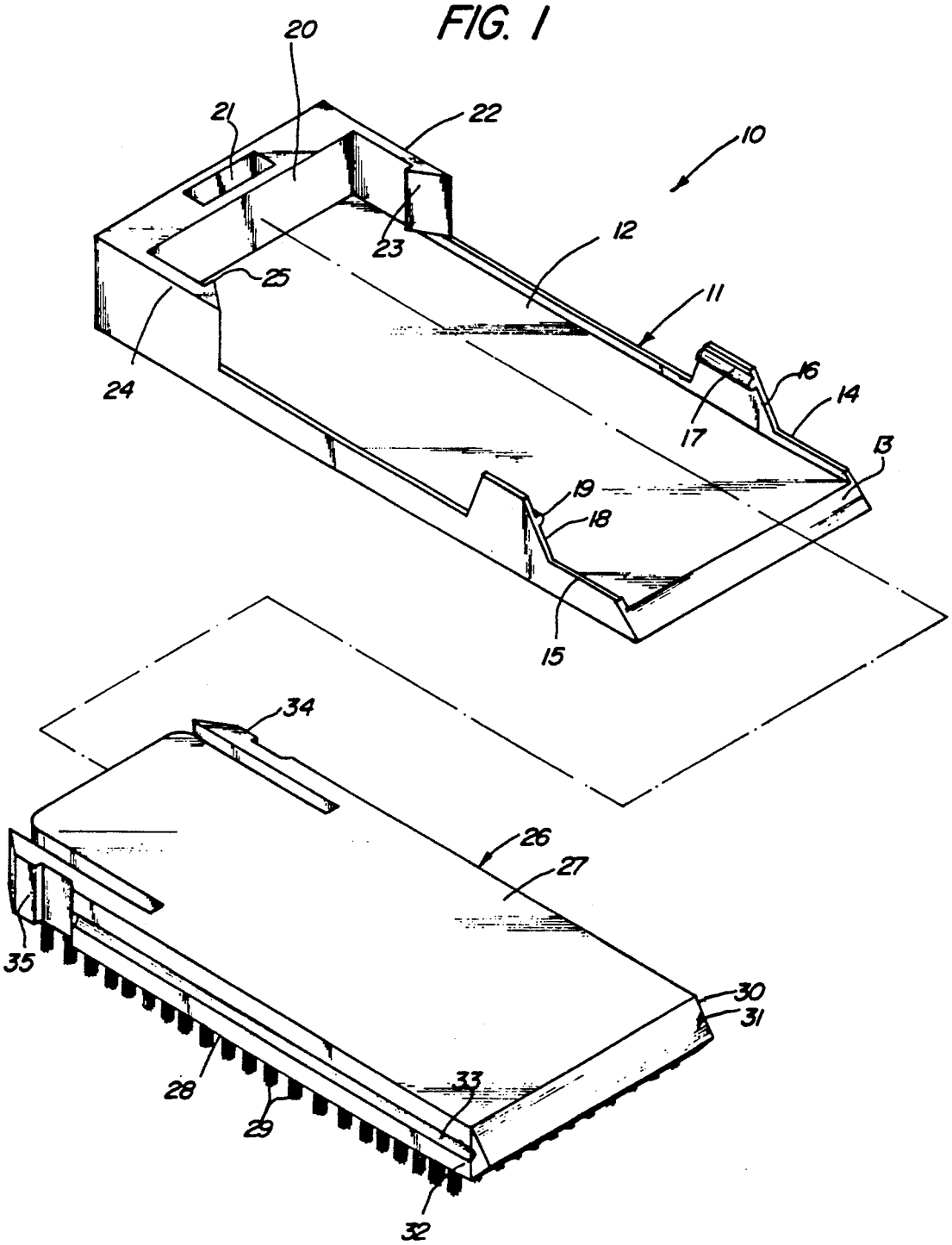
FIG. 1 is an isometric illustration of the invention.

With reference now to the drawings, and in particular to FIGS. 1 to 7 thereof, a new and improved golf equipment brush embodying the principles and concepts of the present invention and generally designated by the reference numerals 10, 10*a*, and 10*b* will be described.

More specifically, the golf equipment brush 10 of the instant invention, as illustrated in the FIG. 1, includes a support housing 11 formed with a planar housing floor 12, including a canted floor entrance apron 13 permitting ease of directing of the associated brush head 26 onto the planar floor 12 for interconnection of the housing 11 and the brush head 26. The housing 11 further includes a housing first side wall 14 spaced from and parallel a housing second side wall 15. A first side wall flange 16 and a second side wall flange 18 are arranged in a parallel relationship adjacent the entrance apron 13 and extend upwardly of the respective first and second side walls in a coplanar relationship formed with respective confronting first and second first flange ribs 17 and 19. A rear wall 20 orthogonally and integrally mounted to the floor 12 is orthogonally oriented between the side walls 14 and 15 and extending between associated first and second rear side wall flanges 22 and 24 that each in turn include respective first and second flange projections 23 and 25 respectively.

The brush head 26 includes a brush head top wall 27 spaced from a brush head bottom wall 28 in a coextensive relationship, with a matrix of bristle tufts 29 projecting orthogonally and downwardly relative to the bottom wall 28. A brush head first side wall 30 is spaced from a brush head second side wall 32 a predetermined spacing substantially equal to the predetermined spacing between the housing first and second side walls 14 and 15. A brush head first side wall groove 31 arranged parallel and coextensive with a brush head second side wall groove 33 receive the respective first and second side wall flange ribs 17 and 18 therewithin in a sliding and engaging relationship. A first side wall spring finger 34 and a second side wall spring finger 35 are engaged by the respective first and second rear side wall flange projections 23 and 25. To effect release of the brush head 26, the first and second side wall spring fingers 34 and 35 are merely compressed towards one another to effect their release relative to the projections 23 and 25 to effect a sliding removal of the brush head 26 relative to the support housing 11.

Figure 2:
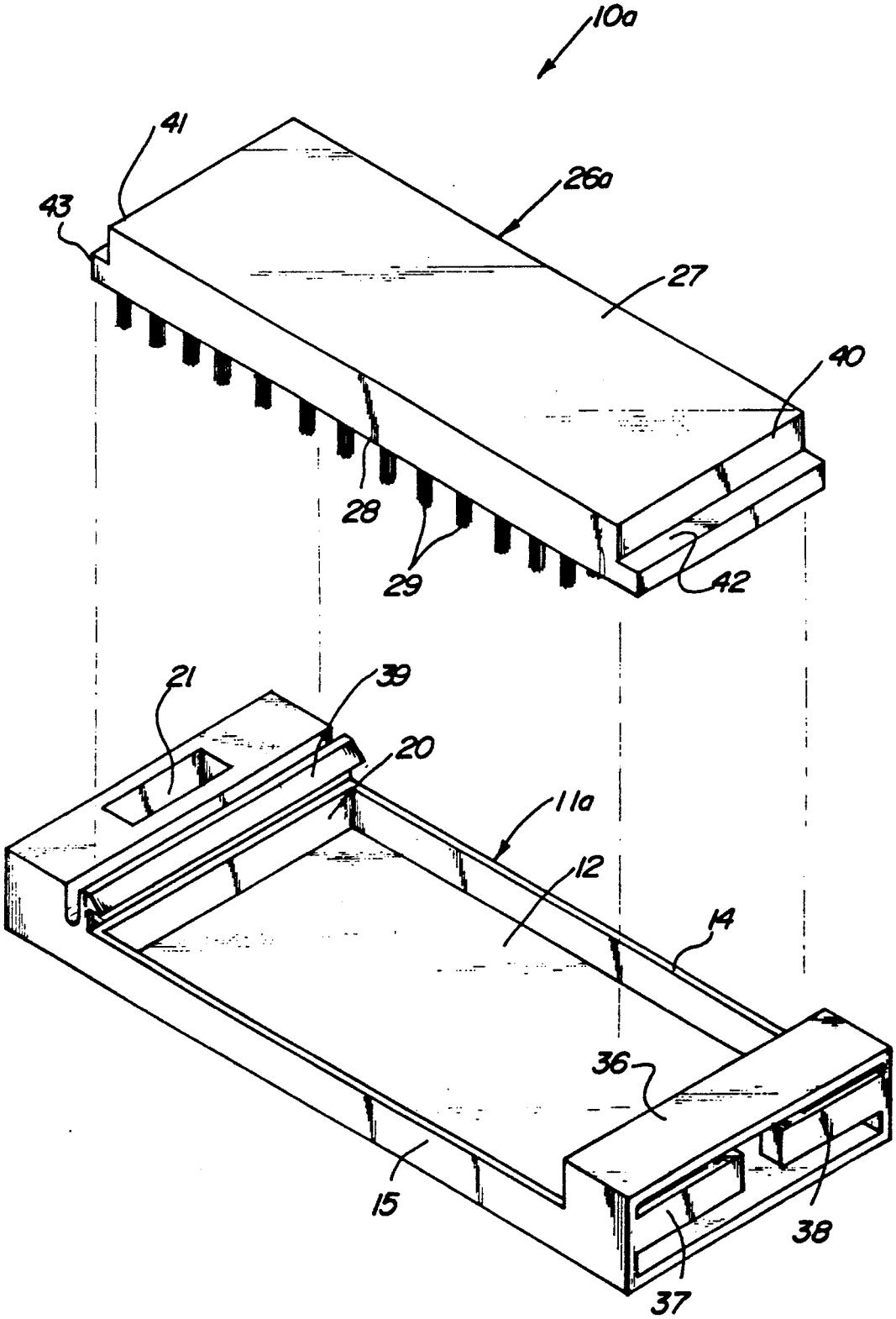
FIG. 2 is an isometric illustration of a modified aspect of the invention.

The apparatus 10*a*, as illustrated in FIG. 2, includes the housing 11*a* formed with a housing loop 36 mounted adjacent a forward distal end of the housing, including the use of the first and second spring legs 37 and 38 mounted within the loop 36, wherein a brush head forward end wall flange 42 mounted to the brush head forward end wall 40 is received within the loop, with the spring legs biasing the brush head and its associated brush head rear end wall flange 43 mounted to the brush head rear end wall 40 below a rear wall rib 39 that is spaced above the rear wall 20. It should be noted that the FIGS. 1 and 2 of the inventions 10 and 10*a* each include a respective belt receiving bore 21 positioned rearwardly of the rear wall 20, with the bore oriented substantially orthogonally relative to the floor 12. In this manner, securement of the organization relative to an individual or to an equipment bag is readily available.

Figure 3:
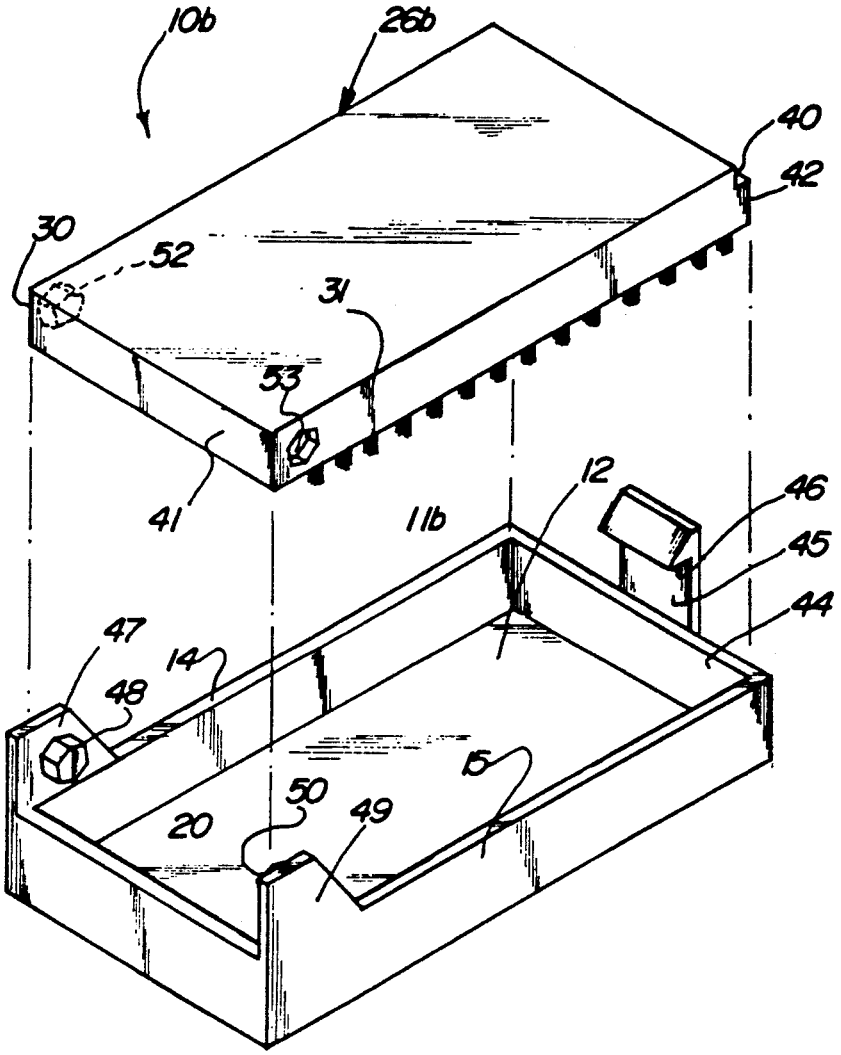
FIG. 3 is an isometric illustration of a further modified aspect of the invention.
Figure 4:
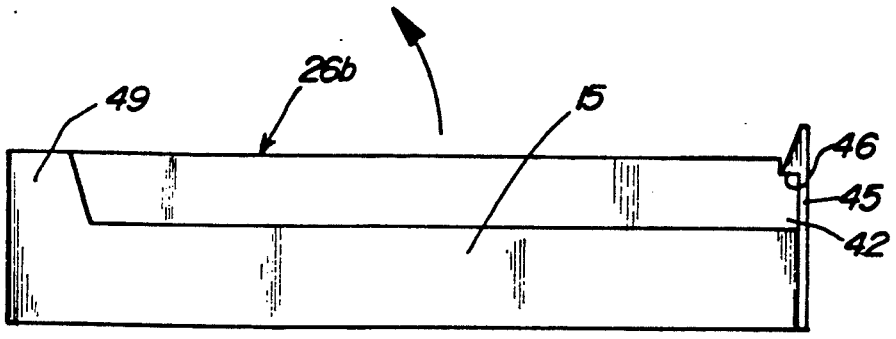
FIG. 4 is an orthographic side view, taken in elevation, of the invention as set forth in FIG. 3.

The invention 10*b*, as illustrated in the FIGS. 3 and 4, includes a support housing front end wall 40 formed with the aforenoted rear end wall flange 42 that is received in abutment with a support housing front wall 44 arranged parallel relative to the rear wall 20, with the support housing front wall 44 including a latch bar 45 extending upwardly and orthogonally relative to the floor 12, including a projecting wall 45 arranged for reception over the forward end wall flange 42, in a manner as illustrated in FIG. 4. The support housing including a support housing first side wall flange plate 47 and second side wall flange plate 49 include respective first and second lugs 48 and 50 mounted thereon received within respective first and second lug cavities 52 and 53 positioned into the brush housing side walls 30 and 31 adjacent the brush head rear end wall 41. The first and second side wall flange plates 47 and 49 are resiliently biased towards one another, whereupon they permit deflection relative to one another in a spaced relationship to permit the removal of the lugs 48 and 50 from the lug cavities 52 and 53.

Figure 5:
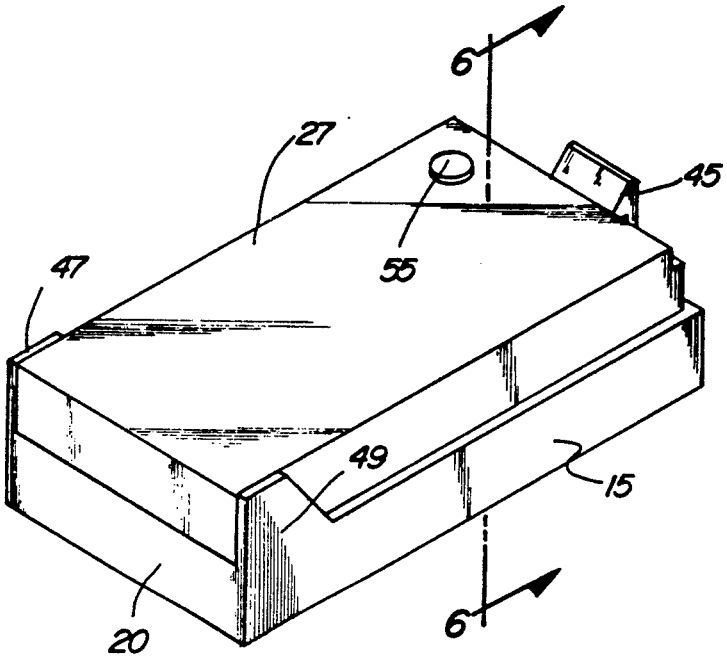
FIG. 5 is an isometric illustration of the invention utilizing a fluid reservoir contained therewithin.
Figure 6:
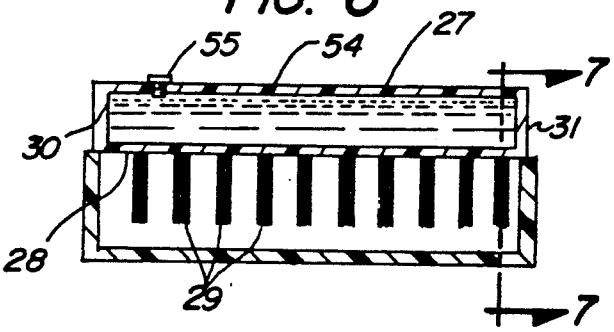
FIG. 6 is an orthographic view, taken along the lines 6—6 of FIG. 5 in the direction indicated by the arrows, illustrating the reservoir in association with the bristle tufts.
Figure 7:
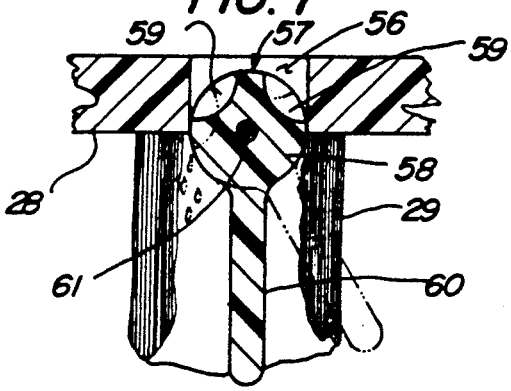
FIG. 7 is an orthographic view, taken along the lines 7—7 of FIG. 6 in the direction indicated by the arrows, to illustrate the cooperation of the valve member in association with each bristle tuft.

The FIGS. 5 and 6 further include the organization as set forth in FIG. 3 to include a brush head fluid chamber 54 positioned between the brush head top wall 27 and the brush head bottom wall 28, with a fill plug 55 removably mounted through the top wall to permit selective refilling of a cleaning solvent fluid of any commercially available type within the chamber 54. The bristle tufts 29 each include fluid alignment with a fluid directing valve port 56 of a matrix of such fluid ports directed through the bottom wall 28, with a metering valve 57 pivotally mounted within each fluid port about a valve head axle 61. The metering valve 57 includes a spherical valve head 58 contained within an associated cylindrical valve port 56, with the valve head 58 including a plurality of valve head fluid receiving pockets 59 formed within the valve head about an upper hemisphere thereof. A valve head leg 60 bisecting the lower hemisphere projects downwardly thereof orthogonally oriented and relative to the axle 61, whereupon utilization of the bristle tufts 29 against golf equipment effects deflection of the valve head leg 60 and the displacement of cleaning fluid from the chamber 54 through the pockets 59 as the upper hemisphere of the spherical valve head 58 is pivoted. It should be noted in this vein that the valve head axle 61 is substantially aligned with the floor 28, whereupon pivotment of the valve leg 60 orients the pockets in fluid communication between the chamber 54 and the tufts 29 to direct fluid into each tuft and thereby meter such cleaning fluid in a golf equipment cleaning procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf equipment brush, comprising, a support housing, the support housing including a planar housing floor, the planar housing floor including a housing first side wall spaced from and parallel a second housing second side wall at predetermined spacing, and further including a housing rear wall, and a brush head arranged for mounting between the first side wall and the second side wall, wherein the brush head includes a brush head top wall spaced from a brush head bottom wall, and a matrix of bristle tufts orthogonally and fixedly mounted to the brush head bottom wall extending downwardly therefrom, wherein the brush head includes a brush head first side wall spaced from a brush head second side wall a spacing substantially equal to the predetermined spacing, and the housing includes a housing first side wall flange plate spaced from and parallel a housing second side wall flange plate extending upwardly in a coplanar relationship relative to the respective housing first and second side walls, with the housing first side wall flange plate and the housing second side wall flange plate orthogonally oriented to the housing rear wall and in intersecting adjacency to the housing rear wall, and the housing first side wall flange plate includes a first flange plate lug orthogonally oriented to the first side wall flange plate, and the housing second side wall flange plate includes a second side wall lug orthogonally oriented relative to the second side wall flange plate, with the first side wall lug and the second side wall lug coaxially aligned relative to one another in confronting relationship with the brush head first side wall including a first lug cavity, with the brush head second side wall including a second lug cavity, wherein the first lug cavity and the second lug cavity are coaxially aligned to respectively receive the first flange plate lug and the second flange lug respectively therewithin, and the housing first side wall flange plate and the housing second side wall flange plate are mounted to the housing first side wall and the housing second side wall to permit deflection of the housing first side wall flange plate relative to the housing second side wall flange plate to permit removal of the brush head relative to the housing, and the housing includes a housing front wall, the housing front wall is arranged parallel relative to the housing rear wall, and the brush head includes a brush head forward end wall, the forward end wall including a forward end wall flange projecting beyond the brush head forward end wall, and the support housing front wall includes a latch plate fixedly mounted to the housing forward end wall orthogonally oriented relative to the housing floor, with the latch plate extending above the housing forward end wall, with the latch plate including a latch plate projecting wall arranged for reception of the brush head forward end wall flange when the brush head is mounted within the support housing, and the brush head includes a fluid chamber between the brush head top wall and the brush head bottom wall, and a fill plug directed through the brush head top wall for selective filling of the chamber, and the brush head bottom wall including a matrix of cylindrical fluid ports directed therethrough, and each fluid port of said matrix of cylindrical fluid ports is coaxially aligned with one bristle tuft of said matrix of bristle tufts, and each fluid port includes a metering valve contained therewithin, and each metering valve includes a spherical valve head pivotally mounted therewithin, wherein each spherical valve head includes a valve head axle, and each valve head axle is aligned with the brush head bottom wall, and each spherical valve head includes at least one fluid receiving pocket directed into the spherical valve head about an upper hemisphere of the spherical valve head, and the spherical valve head further includes a valve head leg medially intersecting a lower hemisphere of the spherical valve head projecting downwardly relative to the spherical valve head within an underlying bristle tuft.

* * * * *